US006052086A

United States Patent [19]

Kudoh

[11] Patent Number: 6,052,086

[45] Date of Patent: Apr. 18, 2000

[54] ARRAY ANTENNA, ANTENNA DEVICE WITH THE ARRAY ANTENNA AND ANTENNA SYSTEM EMPLOYING THE ANTENNA DEVICE

[75] Inventor: Hiroshi Kudoh, Wako, Japan

[73] Assignee: Honda Giken Kogyo Kabushiki Kaisha, Tokyo, Japan

[21] Appl. No.: 08/929,958

[22] Filed: Sep. 15, 1997

[30] Foreign Application Priority Data

Sep. 18, 1996 [JP] Japan ..... 8-246541

[51] Int. Cl.[7] ..... H01Q 1/38

[52] U.S. Cl. ..... 343/700 MS; 343/853

[58] Field of Search ..... 343/700 MS, 853, 343/754

[56] References Cited

U.S. PATENT DOCUMENTS

| | | | |
|---|---|---|---|
| 4,684,952 | 8/1987 | Munson et al. | 343/700 MS |
| 4,963,892 | 10/1990 | Matsuo et al. | 343/700 MS |
| 5,001,493 | 3/1991 | Patin et al. | 343/700 MS |
| 5,400,040 | 3/1995 | Lane et al. | 343/700 MS |

FOREIGN PATENT DOCUMENTS 4-97529 3/1992 Japan .

6-254470 9/1994 Japan .

*Primary Examiner*—Michael C. Wimer
*Attorney, Agent, or Firm*—Lyon & Lyon LLP

[57] ABSTRACT

An array antenna includes a plurality of patches arrayed on a first surface of a base board and a plurality of feeders connected to the respective patches so as to radiate or receive an electromagnetic wave via the patches. The patches include a plurality of first patches and a plurality of second patches. The feeders connected to the first patches are formed on the first surface of the base board, while the feeders connected to the second patches are formed on a second surface of the base board. Further, first and second transmitting and receiving circuits are provided on the first and second surfaces, respectively, of the base board, so as to provide an antenna device. The first transmitting and receiving circuit feeds or receives electrical signals to or from the first patches, while the second transmitting and receiving circuit feeds or receives electrical signals to or from the second patches. The first and second transmitting and receiving circuits are both positioned on the same side of the arrayed patches. With such arrangements, the directivities of a first antenna unit with the first patches and of a second antenna unit with the second patches can be made different from each other, and the overall size of the antenna device can be reduced to a considerable degree.

18 Claims, 5 Drawing Sheets

ARRAY ANTENNA, ANTENNA DEVICE WITH THE ARRAY ANTENNA AND ANTENNA SYSTEM EMPLOYING THE ANTENNA DEVICE

BACKGROUND OF THE INVENTION

1. Field of the Invention

The present invention relates to an improved array antenna, and also relates to an antenna device including the improved array antenna and an antenna system employing such an antenna device.

2. Description of the Related Art

Japanese Patent Laid-Open Publication No. HEI-5-251928 discloses an antenna device, which includes an IC board with a transmitting and receiving circuit mounted thereon and a horn-type primary radiator. Further, Japanese Patent Laid-Open Publication No. HEI-8-97620 discloses an array antenna which includes a plurality of patch antennas arrayed on a dielectric substrate, a feed and feed lines or feeders connecting between the feed and the individual patch antennas. The feeders, in the form of microstrips, are formed on the dielectric substrate together with the patch antennas.

Among various known examples of the array antenna is a phased array antenna, which is designed to vary a phase difference between adjacent antenna elements to change the direction of radiated beams, to thereby switch the direction of the main lobe. The array antennas, which comprise an array of planar antennas of same structure, can be used as a phased array antenna by just varying a phase difference between adjacent antenna elements; however, it is difficult to vary their directivity of the array antenna depending on, for example, the size and distance (from the antenna) of objects that are to be detected. Further, the array antennas, having patches of individual planar antenna elements and associated feeders formed on a same planar surface, present the problem that their directivities would considerably deteriorate due to unwanted radiation of electromagnetic waves from the feeders, although they provide a very simple feeding scheme.

SUMMARY OF THE INVENTION

Therefore, it is a primary object of the present invention to provide an array antenna capable of varying its directivity as desired.

It is another object of the present invention to provide a small-size antenna device including the directivity-variable array antenna.

It is yet another object of the present invention to provide an antenna system which employs the small-size antenna device including the directivity-variable array antenna.

According to a first aspect of the present invention, there is provided an array antenna, which comprises a plurality of patches arrayed on a first surface of a base board and a plurality of feeders connected to respective ones of the patches so as to radiate or receive an electromagnetic wave via the patches. The plurality of patches comprises a plurality of first patches and a plurality of second patches. The feeders connected to the first patches are formed on the first surface of the base board, while the feeders connected to the second patches are formed on a second surface of the base board opposite to the first surface.

Because the feeders connected to the first and second patches are formed on the first and second surfaces, respectively, of the base board and thus they differ in geographical position and form of electrical connection, the directivities of a first antenna unit with the first patches and of a second antenna unit with the second patches can be made different from each other. By simultaneously using a combination of optionally selected first and second patches (e.g., by simultaneously radiating electromagnetic waves via selected first and second patches) and varying phase differences between the selected patches, the directivities of the first and second antenna units can be varied. Further, because the feeders for the first and second patches are formed on the different surfaces of the base board, the interval between adjacent feeders on each of the surfaces can be made greater than where they are all formed on a single surface of the base board. The greater interval between the feeders can effectively reduce undesirable noise that would result from mutual radiation between the feeders.

Preferably, the base board comprises an earth plate made of an electrically conductive material and a pair of dielectric substrates sandwiching the earth plate therebetween. The feeders, earth plate and one of the dielectric plates disposed between the feeders and the earth plate together constitute microstrips, and the first patches, earth plate and the one dielectric substrate disposed between the first patches and the earth plate together constitute patch antennas. The second patches, earth plate and the other dielectric plate disposed between the second patches and the earth plate together constitute inductance-coupling patch antennas with a plurality of slots formed in the earth plate.

With the inductance-coupling patch antenna arranged in the above-mentioned manner, it is possible to save the labor necessary to connect the second patches and the associated feeders on the second surface via conductor lines (which may for example be through-holes) extending across the thickness of the base board, by using the mutual induction to feed to the second patches. Because the feeding to a selected one of the second patches is effected through the slot of a non-resonating length that is formed in the earth plate, the impedance can be adjusted by varying the dimensions of the slot. Further, by the earth plate interposed between the second patches and the feeders, it is possible to enhance the directivity of the inductance-coupling patch antenna while avoiding unwanted radiation from the feeder to the first surface.

Preferably, the first patches and second patches are arrayed alternately on the first surface of the base board. This alternate arrangement can increase the interval between adjacent feeders on each of the surfaces so that noise resulting from the mutual radiation between the feeders is minimized.

In a preferred implementation, the array antenna comprises an additional dielectric substrate covering the second surface of the base board, or an additional dielectric substrate that includes an additional earth plate covering the second surface of the base board. The first-said additional dielectric substrate protects the feeders formed on the second surface of the base board and reinforces the base board. The second-said additional dielectric substrate, including the additional earth plate covering the second surface of the base board, can protect the feeders, reinforce the base board and also effectively reduces unwanted radiation to the reverse side of the base board.

According to a second aspect of the present invention, there is provided an antenna device including the above-mentioned array antenna. This antenna device comprises a first transmitting and receiving circuit for feeding electrical signals to the first patches of the array antenna or receiving electrical signals from the first patches, and a second transmitting and receiving circuit for feeding electrical signals to the second patches of the array antenna or receiving electrical signals from the second patches. The first transmitting and receiving circuit is provided on the first surface of the base board, the second transmitting and receiving circuit is provided on the second surface of the base board, and the first and second transmitting and receiving circuits are both positioned on a same side of the patches.

The mounting areas on the base board can be used very efficiently, so that the base board and hence the entire antenna device can be substantially reduced in size. Furthermore, by providing the transmitting and receiving circuits on one same side of the corresponding arrayed patches, the necessary length of connecting wires from an external circuit to the transmitting and receiving circuits can be reduced effectively. The reduced wire length results in a reduced transmission loss and also effectively reduces influences of unwanted radiation to and from the wires.

Preferably, the first and second transmitting and receiving circuits are capable of selecting any of said patches to or from which electrical signals are to be fed or received and phases of the selected patches. This arrangement allows the directivity of the array antenna to be varied optionally, and also permits beam formation, beam scanning and generation of time-divisional multibeams.

According to a third aspect of the present invention, there is provided an antenna system which comprises first and second radiators, and wherein the first radiator is the above-mentioned antenna device and the second radiator is a reflector or a lens.

Because the antenna device can be of compact size, the reduced overall size of the base board can effectively avoid aperture blocking by the board. Thus, the reflector can be made greater in size so that the radiated beam from any of the patches is reflected at more points on the unblocked surface of the reflector to provide more reflected beams. Therefore, the antenna gain can be improved.

The above and other objects, features and advantages of the present invention will become manifest to those versed in the art upon reference to the detailed description and accompanying drawings in which preferred structural embodiments incorporating the principles of the present invention are shown by way of illustrative examples.

BRIEF DESCRIPTION OF THE DRAWINGS

Preferred embodiments of the present invention will be described hereinbelow, by way of example only, with reference to the accompanying drawings, in which.

DETAILED DESCRIPTION OF THE PREFERRED EMBODIMENTS

The following description is merely exemplary in nature and is in no way intended to limit the invention or its application or uses.

Figure 1A:
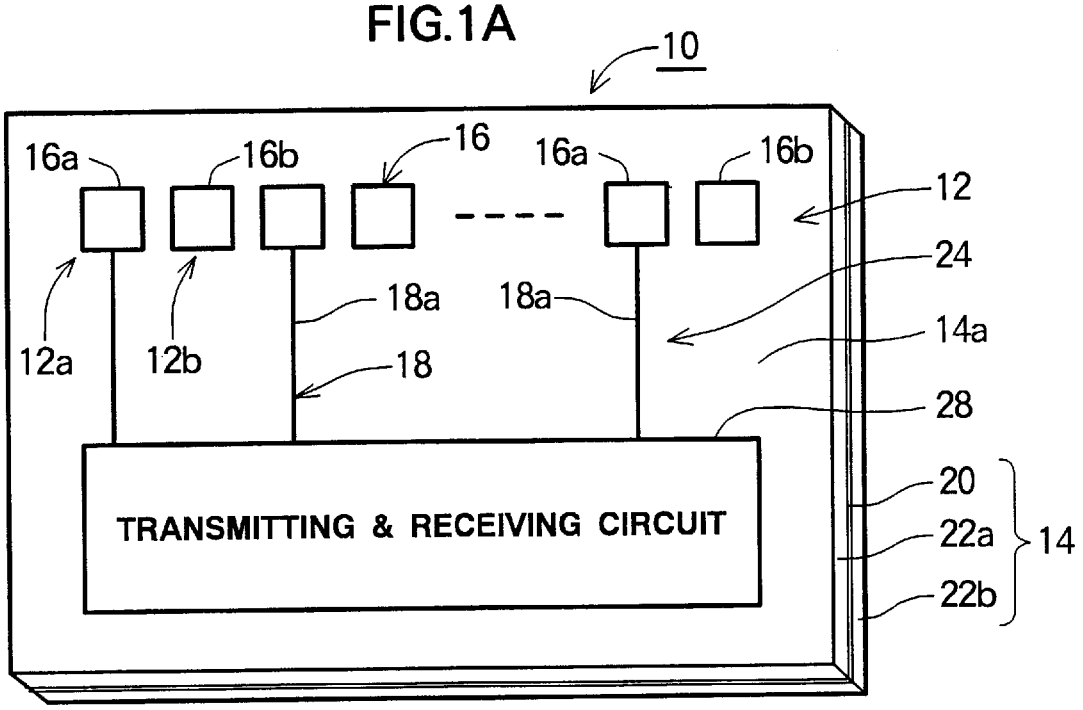
FIG. 1A is a schematic top plan view of an antenna device including an array antenna according to the present invention.
Figure 1B:
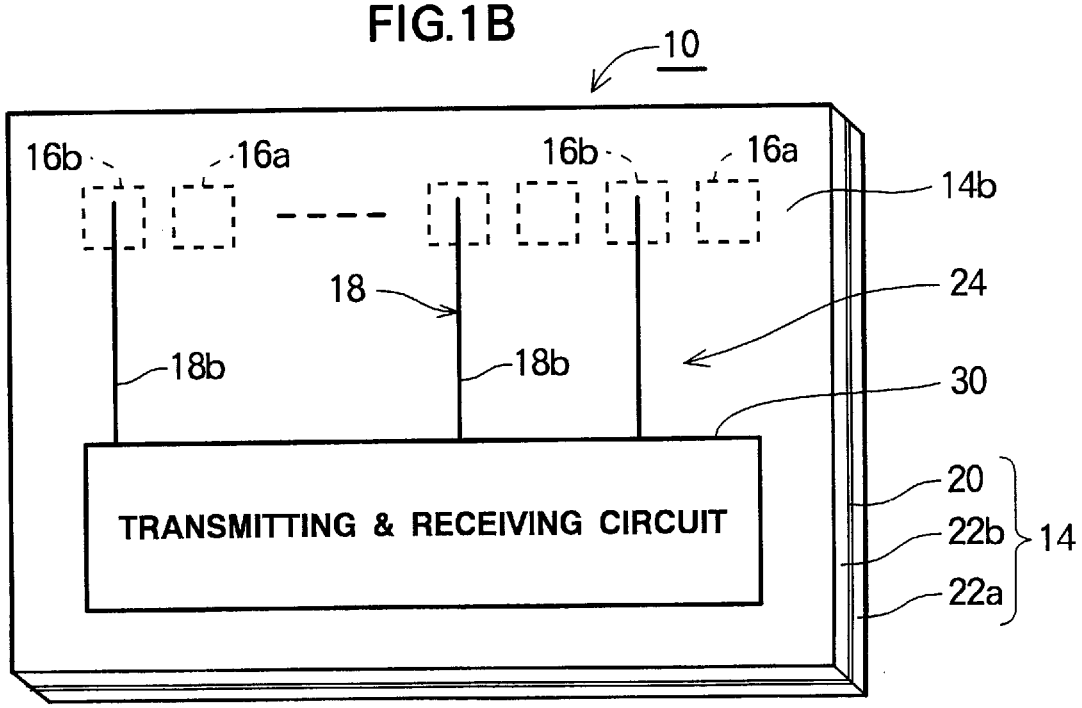
FIG. 1B is a schematic bottom plan view of the antenna device shown in FIG. 1A.

FIGS. 1A and 1B show an antenna device 10 according to a preferred embodiment of the present invention, which comprises an array antenna as will be described in detail below. Specifically, FIG. 1A is a schematic top plan view of the antenna device 10, and FIG. 1B is a schematic bottom plan view of the antenna device shown in FIG. 1A. The array antenna 12 includes a base board 14, on a first surface (obverse side) 14*a* of which are provided an array of patches 16 and a plurality of feeders 18 connected to the respective patches 16. Via these patches 16, the antenna device 10 radiates and receives an electromagnetic wave.

The patches 16 comprise a plurality of first and second patches 16*a* and 16*b*, and the feeders 18*a* connected to the first patches 16*a* are formed on the first surface 14*a* of the base board 14 while the feeders 18*b* connected to the second patches 16*b* are formed on a second surface (reverse side) 14*b* of the base board 14.

The base board 14 comprises an earth plate 20 made of an electrically conductive material, and a pair of dielectric substrates 22*a* and 22*b* sandwiching the earth plate 20 therebetween. The feeders 18*a* connected to the first patches 16*a* and earth plate 20, as well as the dielectric substrate 22*a* located between the feeders 18*a* and the earth plate 20, together constitute microstrips 24. Similarly, the feeders 18*b* connected to the second patches 16*b* and earth plate 20, as well as the dielectric substrate 22*b* located between the feeders 18*b* and the earth plate 20, together constitute microstrips 24.

The first patches 16*a*, earth plate 20, dielectric substrate 22*a* located between the feeders 18*a* and the earth plate 20 together constitute patch antennas (microstrip antennas) 12*a*. The feeders 18*b* connected to the second patches 16*b*, earth plate 20 and dielectric substrate 22*b* located between the feeders 18*b* and the earth plate 20 together constitute inductance-coupling patch antennas 12*b* with a plurality of slots 26 in the earth plate 20. Each of the slots 26 is elongated in the direction where the patches are arrayed. The array of the first patches 16*a* form an array of patch antennas 12*a*, and a time-divisional scanning antenna assembly or a phased array antenna can be provided by selecting any of the patches 16*a* and a phase of each selected patch 16*a*. Similarly, the array of the second patches 16*b* form an array of the inductance-coupling patch antennas 12*b*, and a time-divisional scanning antenna assembly or a phased array antenna can be provided by selecting any of the patches 16*b* and a phase of each selected patch 16*b*.

As noted above, the feeders 18*a* and 18*b* connected to the first and second patches 16*a* and 16*b* are formed on the first and second surfaces 14*a* and 14*b*, respectively, of the base board 14. Thus, the feeders 18*a* and 18*b* of the first and second patches 16*a* and 16*b* differ in geographical position and form of electrical connection, so that the patch antennas 12*a* and inductance-coupling patch antennas 12*b* can have different directivities.

Thus, the respective directivities of the patch antennas 12*a* and inductance-coupling patch antennas 12*b* can be varied, by simultaneously using a combination of optionally selected first and second patches 16*a* and 16*b* (e.g., by simultaneously radiating electromagnetic waves via selected first and second patches 16*a* and 16*b*) and varying phase differences between the selected patches 16*a* and 16*b*. Because the directivities of the patch antennas 12*a* and inductance-coupling patch antennas 12*b* can be varied variously in the above-mentioned manner, the array antenna 12 can also be used as an "adaptive" array antenna which is capable of lowering the directivity in a specific direction when a jamming electromagnetic wave arrives from that specific direction.

Further, because the feeders 18*a* and 18*b* are formed on the different surfaces 14*a* and 14*b* of the base board 14, the interval between adjacent feeders 18*a* or 18*b* on each of surfaces 14*a* or 14*b* can be made greater than where they are all formed on a single surface of the base board 14. The greater interval between the feeders 18*a* or 18*b* can effectively reduce unwanted noise that would result from the mutual radiation between the feeders 18*a* or 18*b*.

Furthermore, the microstrips 24, which are formed by the feeders 18*a*, earth plate 20 and dielectric substrate 22*a*, can minimize a transmission loss. Similarly, the microstrips 24, which are formed by the feeders 18*b*, earth plate 20 and dielectric substrate 22*b*, can minimize a transmission loss. Moreover, with the first patches 16*a*, earth plate 20 and dielectric substrate 22*a* forming the patch antennas (microstrip antennas) 12*a*, these antennas 12*a* can be readily connected to the microstrips 24 formed by the feeders 18*a*, earth plate 20 and dielectric substrate 22*a*.

In the array antenna 12 shown in FIGS. 1A and 1B, the first and second patches 16*a* and 16*b* are arranged alternately at equal intervals on the first surface 14*a* of the base board 14. Because of the alternate arrangement of the first and second patches 16*a* and 16*b*, the feeders 18*a* or 18*b* on each of the surfaces 14*a* or 14*b* can be disposed at greater intervals than where the first and second feeders 18*a* and 18*b* are formed in succession on a single surface of the base board 14, with the result that it is possible to avoid noise resulting from the mutual radiation between the feeders 18*a* or 18*b*. Alternatively, the first and second patches 16*a* and 16*b* may be arranged at non-equal intervals, and the radiating characteristics may be controlled by varying the number of the patches and phase differences among the patches.

Figure 2:
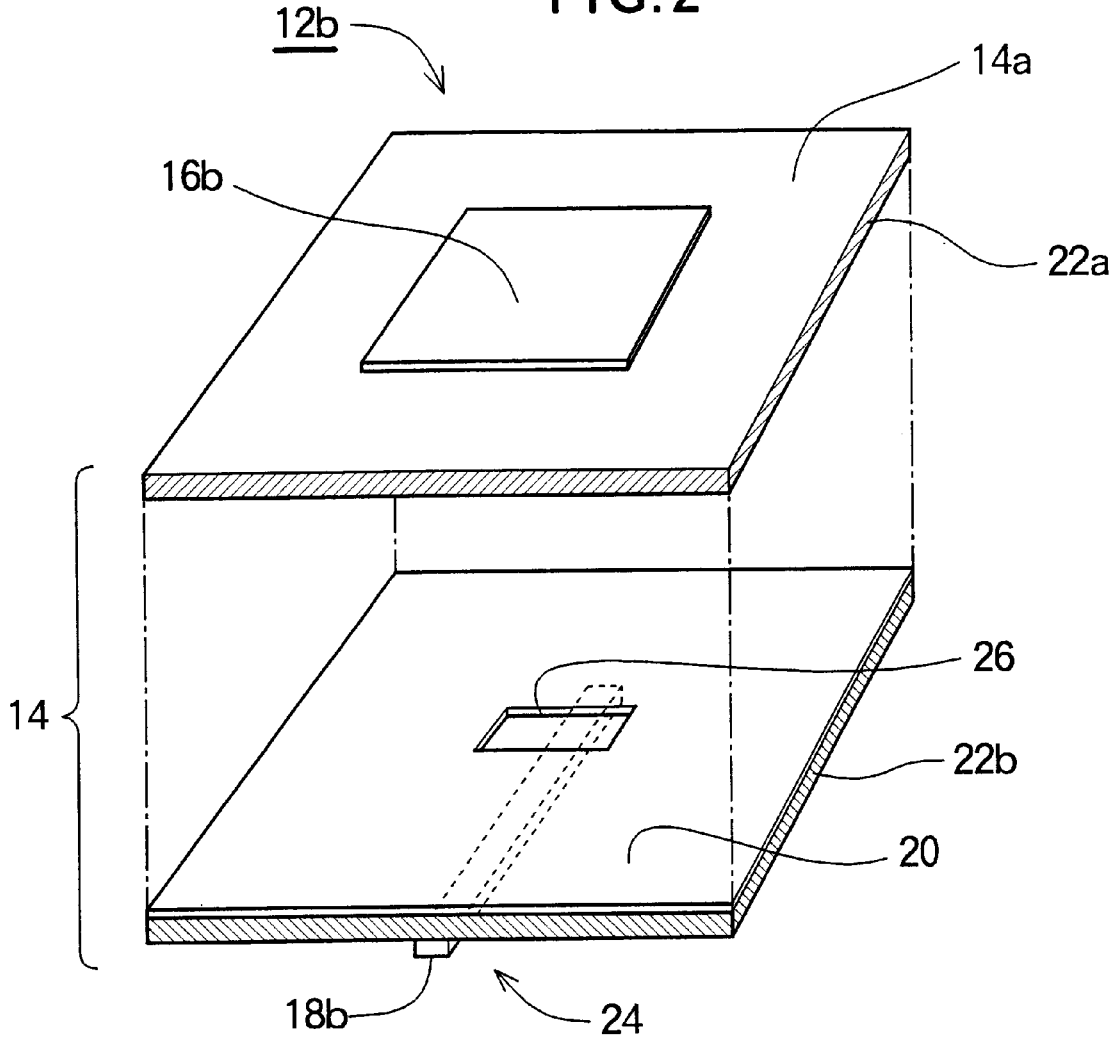
FIG. 2 is a perspective view of an inductance-coupling patch antenna, showing a patch and various elements provided around the patch.

FIG. 2 is a perspective view of one of the above-mentioned inductance-coupling patch antennas 12, showing one of the patches 16*b* and various elements provided around the patch 16*b* described earlier in relation to FIG. 1A. Each of the patches 16*b* is sized to cause resonance, and the slot 26 provided in corresponding relation to the patch 16*b* is smaller in length than one-half the wavelength. With the inductance-coupling patch antenna 12*b*, it is possible to save the labor necessary to connect the second patch 16*b* and the associated feeder 18*b* on the second surface 18*b* via a conductor line (such as a through-hole) extending across the thickness of the base board 14, by using the mutual induction to feed to the second patch 16*b*. Because the feeding to the second patch 16*b* is effected through the slot 26 of a non-resonating length formed in the earth plate 20, the impedance can be adjusted by varying the dimensions of the slot 26. Further, by the earth plate 26 interposed between the second patch 16*b* and the feeder 18*b*, it is possible to enhance the directivity of the inductance-coupling patch antenna 12*b* while effectively avoiding unwanted radiation from the feeder 18*b* to the first surface 14*a*.

The antenna device 10 shown in FIGS. 1A and 1B further includes a first transmitting and receiving circuit 28 (FIG. 1A) which feeds (i.e., sends electrical signals) to the first patches 16*a* of the above-mentioned array antenna 12 and receives input electrical signals from the first patches 16*a*. The antenna device 10 also includes a second transmitting and receiving circuit 30 (FIG. 1B) which feeds (i.e., sends electrical signals) to the second patches 16*b* of the above-mentioned array antenna 12 and receives input electrical signals from the second patches 16*b*. The first transmitting and receiving circuit 28 is provided on the first surface 14*a* of the base board 14, while the second transmitting and receiving circuit 30 is provided on the second surface 14*b*. Further, the first and second transmitting and receiving circuits 28 and 30 are both provided on one same side of the corresponding arrayed patches 16*a* and 16*b* to be located near one same side edge of the board 14.

By providing the first and second transmitting and receiving circuits 28 and 30 on the opposite surfaces 14*a* and 14*b* of the base board 14 as mentioned, the base board 14 allows various component elements to be mounted thereon to a higher density (increased mounting density). Therefore, the mounting areas on the base board 14 can be used very efficiently, and the board 14 and hence the entire antenna device can be substantially reduced in size. Further, by thus providing each of the first and second transmitting and receiving circuits 28 or 30 on only one of the surfaces 14*a* or 14*b* separately from the other circuit 30 or 28, the area occupied by the transmitting and receiving circuit 28 or 30 on each of the surfaces can be reduced or halved relative to a case where the circuits 28 and 30 are both provided together only on one of the surfaces 14*a* or 14*b*, which can also contribute to the size reduction of the base board 14.

Furthermore, by providing the transmitting and receiving circuits 28 and 30 on one same side of the corresponding arrayed patches 16*a* or 16*b* to be located near one same side edge of the board 14 as mentioned above, the necessary length of connecting wires (not shown) from an external circuit (not shown) to the circuits 28 and 30 can be reduced. The reduced wire length permits a reduced transmission loss and also effectively reduces influences of unwanted radiation to and from the wires.

Figure 3:
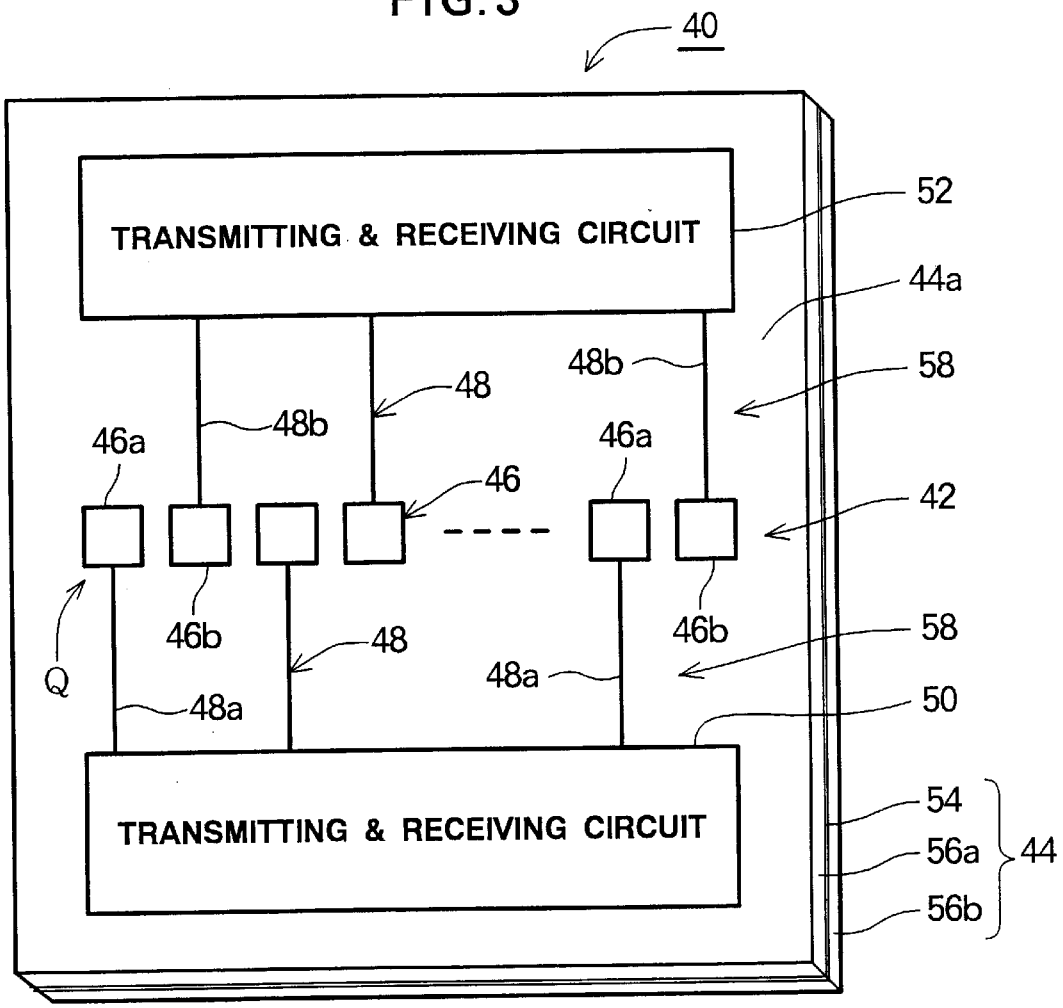
FIG. 3 is a view showing a conventional antenna device to clarify useful features of the present invention.

Each of the first and second transmitting and receiving circuits 28 and 30 may be a switchable transmitting and receiving circuit for radiating multibeams, or may include a combination of an amplifier circuit, a circulator and an antenna-switching PIN diode. Also, each of the first and second transmitting and receiving circuits 28 and 30 may include a FM signal generator, a directivity coupler and a mixer; for example, the transmitting and receiving circuit may be constructed as a radar module as shown in FIG. 3 of Japanese Patent Laid-Open Publication No. HEI-8-97620 and may make a selection from among the patches 16*a*, 16*b* and perform phase control of each selected patch. The first and second transmitting and receiving circuits 28 and 30 may be provided on separate IC boards.

FIG. 3 is a view showing an example of a conventional antenna device 40 to clarify useful features of the present invention. The conventional antenna device 40 includes an array antenna 42, which has a plurality of patches arrayed on a single surface of a base board 44, and a plurality of feeders 48 connected to the respective patches 48. The antenna device 40 radiates and receives an electronic wave via the patches 46. The patches 46 comprises a plurality of first patches 46*a* and a plurality of second patches 46*b*, and the feeders 48*a* and 48*b* connected to the first and second patches 46*a* and 46*b* are formed on the single surface 44*a* of the base board 44.

The illustrated conventional antenna device 40 further includes a first transmitting and receiving circuit 50 which feeds (i.e., sends electrical signals) to the first patches 46*a* of the above-mentioned array antenna 42 and receives input electrical signals from the first patches 46*a*. The antenna device 40 also includes a second transmitting and receiving circuit 52 which feeds (i.e., sends electrical signals) to the second patches 46*b* of the above-mentioned array antenna 42 and receives input electrical signals from the second patches 46*b*. The first and second transmitting and receiving circuits 50 and 52 are both provided on the first surface 14*a* of the base board 14 in such a manner that the transmitting and receiving circuit 50 is located on one side of the arrayed patches 46*a* and 46*b* while the second transmitting and receiving circuit 52 is located on the other side of the patches 46*a* and 46*b*.

The base board 44 comprises an earth plate 54 made of an electrically conductive material, and a pair of dielectric substrates 56*a* and 56*b* sandwiching the earth plate 54 therebetween. The feeders 48*a* connected to the first patches 46*a*, earth plate 54 and dielectric substrate 56*a* located between the feeders 48*a* and earth plate 54 together constitute microstrips 58. Similarly, the feeders 48*b* connected to the second patches 46*b*, earth plate 54 and dielectric substrate 56*b* located between the feeders 48*b* and earth plate 54 together constitute microstrips 24. The first and second patches 46*a* and 46*b*, earth plate 20 and dielectric substrate 56*a* located between the patches and the earth plate together constitute patch antennas. The first and second transmitting and receiving circuits 50 and 52 are of the same construction as the above-described counterparts 28 and 30 shown in FIGS. 1A and 1B, respectively. The patches 46 are of the same construction as the above-described patches of FIG. 1A. Further, the number of antennas (antenna elements) in the array antenna 42 is the same as that in the array antenna 12 of FIG. 1A.

Figure 4:
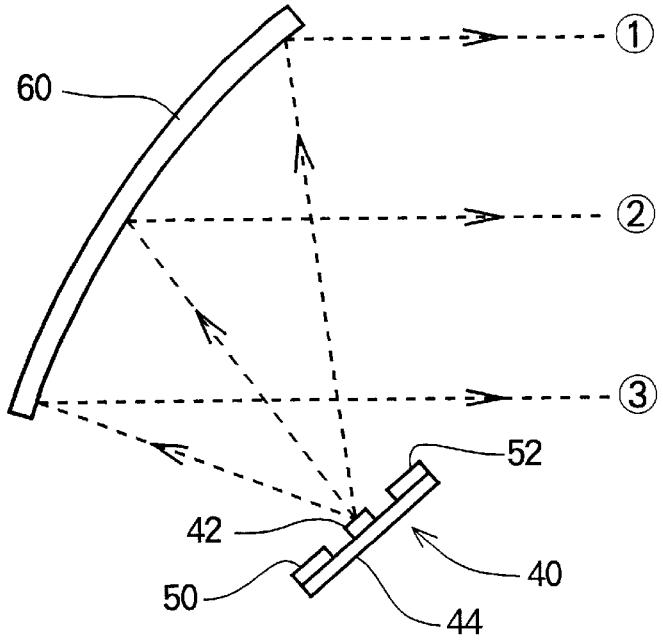
FIG. 4 is a schematic view of an offset parabolic antenna system, where the conventional antenna device of FIG. 3 is employed as a primary radiator and a parabolic reflector is employed as a secondary radiator.
Figure 5:
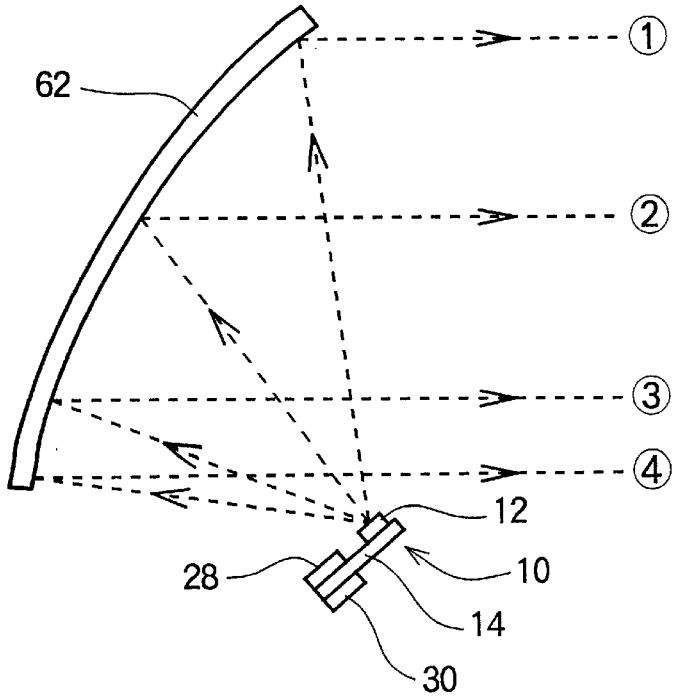
FIG. 5 is a schematic view of an offset parabolic antenna system, where the antenna device of FIGS. 1A and 1B is employed as a primary radiator and a parabolic reflector is employed as a secondary radiator.

FIG. 4 is a schematic view of an offset parabolic antenna system, where the conventional antenna device 40 of FIG. 3 is employed as a primary radiator and a parabolic reflector 60 is employed as a secondary radiator. Similarly, FIG. 5 is a schematic view of an offset parabolic antenna system, where the antenna device 10 of FIGS. 1A and 1B is employed as a primary radiator and a parabolic reflector 62 is employed as a secondary radiator. The two parabolic reflectors 60 and 62 are the same in focal length, and any one of the patches 42 or 12 is positioned at the focal point of each of the reflectors.

In the offset parabolic antenna system of FIG. 4 employing the conventional antenna device 40, the radiated beam is reflected off concave upper end, middle and lower end surface portions of the reflector 60 to provide reflected beams ① to ③. In the offset parabolic antenna system of FIG. 5 employing the antenna device 10 of the present invention, however, the radiated beam is reflected off concave upper end, middle, near-lower-end and lower end surface portions of the reflector 62 to provide reflected beams ① to ④. As will be readily understood from a comparison between the two systems of FIGS. 4 and 5, the base board 14 of the antenna device 10 of the present invention can be substantially reduced in size because the second transmitting and receiving circuit 30 is provided on the reverse side of the base board 14 separately from the first transmitting and receiving circuit 28 on the obverse side. The reduced size of the base board 14 can effectively eliminate aperture blocking by the board 14, and thus the reflector 62 can be made greater in size so that the radiated beam from the patch is reflected at more points on the unblocked concave surface of the reflector 62 to provide more reflected beams. Therefore, the offset parabolic antenna system of FIG. 5, as compared to that of FIG. 4, can improve the antenna gain as well as effectively reducing electric power consumption by the antenna device.

Figure 6:
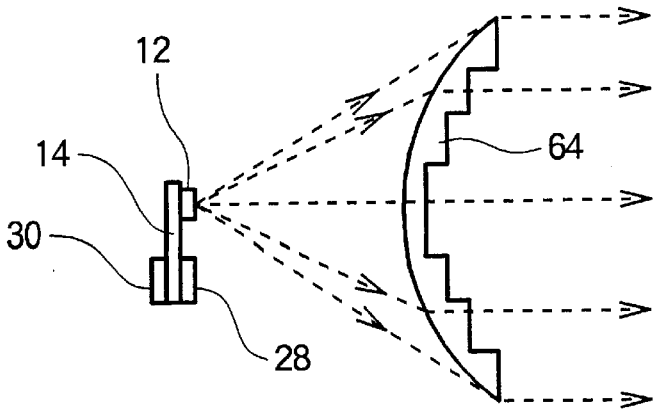
FIG. 6 is a schematic view of an antenna system, where the antenna device of the present invention is employed as a primary radiator in combination with a dielectric lens.

Note that the offset parabolic antenna system of FIG. 5 is capable of generating multibeams by defocused feeding for the individual patches and may be used as a multibeam antenna by varying the primary beam direction. Further, as shown in FIG. 6, the antenna device 10 of the present invention may be combined with a dielectric lens to provide another antenna system. The dielectric lens may be replaced with any other suitable lens, such as a path-length lens or waveguide-shaped metal lens.

Figure 7:
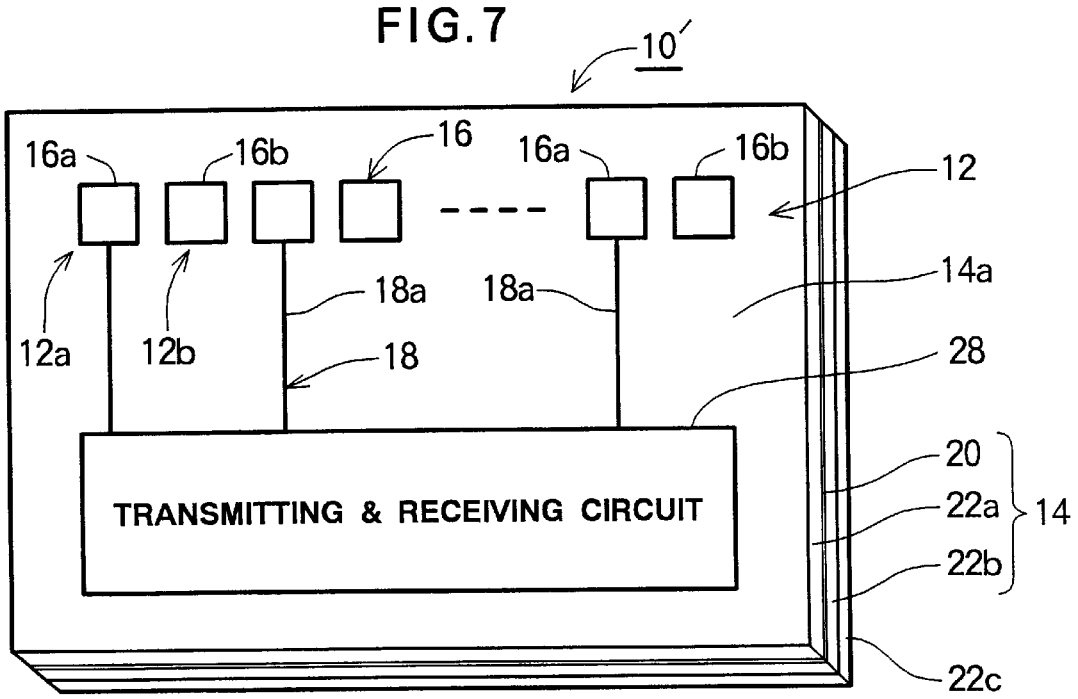
FIG. 7 is a schematic plan view showing a modification of the antenna device of the present invention.
Figure 8:
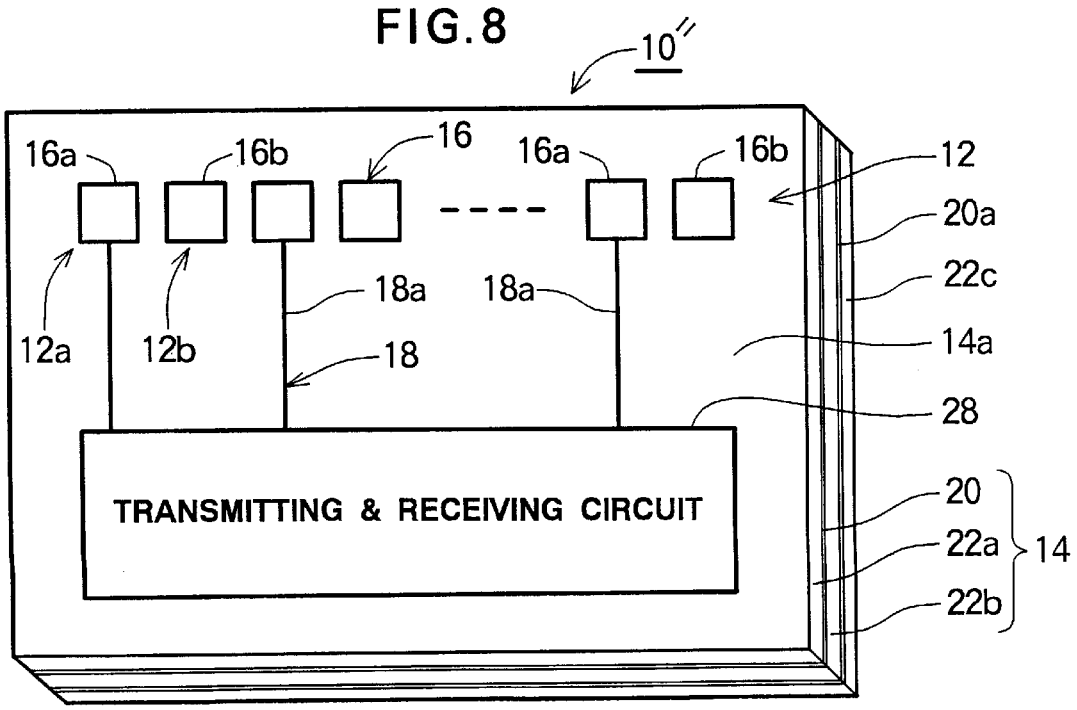
FIG. 8 is a schematic plan view showing another modification of the antenna device of the present invention.

FIGS. 7 and 8 show modifications of the antenna device of the present invention. The modified antenna device 10' of FIG. 7 includes an additional dielectric substrate 22*c* that covers the surface of the dielectric substrate 22*b*, i.e., the second surface 14*b* of the base board 14. The additional dielectric substrate 22*c* protects the feeders 18*b* on the second surface 14*b* of the base board 14 and reinforces the base board 14. The modified antenna device 10" of FIG. 8 includes an additional dielectric substrate 22*c* having an additional earth plate 20*a* that covers the surface of the dielectric substrate 22*b*, i.e., the second surface 14*b* of the base board 14. The additional dielectric substrate 22*c*, having such an additional earth plate 20*a* covering the second surface 14*b* of the base board 14, can protect the feeders 18*b*, reinforce the base board 14 and also effectively reduce unwanted radiation to the reverse side of the base board 14. In particular, it is possible to effectively reduce influences of the unwanted radiation on any circuit provided on the reverse side 14*b* of the base board 14. The base board 14 may be reinforced by employing the earth plates 20 and 20*a* of increased thickness.

The array antenna 12 and antenna device 10, 10' or 10" of the present invention may be applied to a vehicle-mounted radar device for detection of obstacles near the vehicle, or may be applied to an indoor wireless LAN system.

The interval between adjacent antenna elements (patch antennas) of the array antenna 12 may be shorter than one wave length, or equivalent to or shorter than one-half the wavelength, or it may be equivalent to about one-fourth the wavelength. The array antenna 12 may be in a linear array where planar antennas are arranged linearly, or in a planar array where planar antennas are arranged on a same planar surface. Whereas all the patches 16 are shown in the drawings as square patches, either the first patches 16*a* or the second patches 16*b* may be in a circular shape. One side of each of the square patches may be chosen to equal about one-half of the wavelength. For example, the frequency of signals (FM signals) to be fed may be about 60 GHz, one side of each of the square patches may be about 1.6–2.2 mm, and the interval between adjacent square patches may be about 0.2–0.4 mm. The dielectric substrates 22*a* and 22*b* of the base board 14 may be of the same thickness.

Obviously, various minor changes and modifications of the present invention are possible in the light of the above teaching. It is, therefore, to be understood that within the scope of the appended claims the invention may be practiced otherwise than as specifically described.

What is claimed is:

1. An antenna device comprising an array antenna including a plurality of patches arrayed on a first surface of a base board and a plurality of feeders connected to respective ones of said patches so as to radiate or receive an electromagnetic wave via said patches, said plurality of patches comprising a plurality of first patches and a plurality of second patches forming first and second antennas, said feeders connected to said first patches being formed on said first surface of said base board, said feeders connected to said second patches being formed on a second surface of said base board opposite to said first surface;

a first transmitting and receiving circuit for feeding or receiving electrical signals to or from said first patches of said array antenna;

a second transmitting and receiving circuit for feeding or receiving electrical signals to or from said second patches of said array antenna, wherein said first transmitting and receiving circuit is provided on said first surface of said base board, said second transmitting and receiving circuit is provided on said second surface of said base board, and said first and second transmitting and receiving circuits are both positioned on a same side of said patches, and a circuit for optionally selecting ones of said first and second patches for changing the directivities of said first and second antennas with respect to each other.

2. An antenna device as recited in claim 1 wherein said first and second transmitting and receiving circuits are capable of selecting any of said patches to or from which the electrical signals are to be fed or received and phases of the selected patches.

3. An antenna device as recited in claim 1 wherein said base board comprises an earth plate made of an electrically conductive material and a pair of dielectric substrates sandwiching said earth plate therebetween, said feeders, said earth plate and one of said dielectric substrates disposed between said feeders and said earth plate together constitute microstrips, said first patches, said earth plate and said one dielectric substrate disposed between said first patches and said earth plate together constitute patch antennas, and said second patches, said earth plate and another of said dielectric plates disposed between said second patches and said earth plate together constitute inductance-coupling patch antennas with a plurality of slots formed in said earth plate.

4. An antenna device as recited in claim 1 wherein said first patches and said second patches are arrayed alternately on said first surface of said base board.

5. An antenna device as recited in claim 1 which further comprises an additional dielectric substrate covering said second surface of said base board.

6. An antenna device as recited in claim 1 which further comprises an additional dielectric substrate that includes an additional earth plate covering said second surface of said base board.

7. An antenna system comprising first and second radiators, said first radiator being an antenna device, said second radiator being a reflector, said antenna device comprising:

an array antenna including a plurality of patches arrayed on a first surface of a base board and a plurality of feeders connected to respective ones of said patches so as to radiate or receive an electromagnetic wave via said patches, said plurality of patches comprising a plurality of first patches and a plurality of second patches forming first and second antennas, said feeders connected to said first patches being formed on said first surface of said base board, said feeders connected to said second patches being formed on a second surface of said base board opposite to said first surface;

a first transmitting and receiving circuit for feeding or receiving electrical signals to or from said first patches of said array antenna;

a second transmitting and receiving circuit for feeding or receiving electrical signals to or from said second patches of said array antenna, wherein said first transmitting and receiving circuit is provided on said first surface of said base board, said second transmitting and receiving circuit is provided on said second surface of said base board, and said first and second transmitting and receiving circuits are both positioned on a same side of said patches, and a circuit for optionally selecting ones of said first and second patches for changing the directivities of said first and second antennas with respect to each other.

8. An antenna system as recited in claim 7 wherein said first and second transmitting and receiving circuits are capable of selecting any of said patches to or from which the electrical signals are to be fed or received and phases of the selected patches.

9. An antenna system as recited in claim 7 wherein said base board comprises an earth plate made of an electrically conductive material and a pair of dielectric substrates sandwiching said earth plate therebetween, said feeders, said earth plate and one of said dielectric substrates disposed between said feeders and said earth plate together constitute microstrips, said first patches, said earth plate and said one dielectric substrate disposed between said first patches and said earth plate together constitute patch antennas, and said second patches, said earth plate and another of said dielectric plates disposed between said second patches and said earth plate together constitute inductance-coupling patch antennas with a plurality of slots formed in said earth plate.

10. An antenna system as recited in claim 7 wherein said first patches and said second patches are arrayed alternately on said first surface of said base board.

11. An antenna system as recited in claim 7 which further comprises an additional dielectric substrate covering said second surface of said base board.

12. An antenna system as recited in claim 7 which further comprises an additional dielectric substrate that includes an additional earth plate covering said second surface of said base board.

13. An antenna system comprising first and second radiators, said first radiator being an antenna device, said second radiator being a lens, said antenna device comprising:

an array antenna including a plurality of patches arrayed on a first surface of a base board and a plurality of feeders connected to respective ones of said patches so as to radiate or receive an electromagnetic wave via said patches, said plurality of patches comprising a plurality of first patches and a plurality of second patches forming first and second antennas, said feeders connected to said first patches being formed on said first surface of said base board, said feeders connected to said second patches being formed on a second surface of said base board opposite to said first surface;

a first transmitting and receiving circuit for feeding or receiving electrical signals to or from said first patches of said array antenna;

a second transmitting and receiving circuit for feeding or receiving electrical signals to or from said second patches of said array antenna, wherein said first transmitting and receiving circuit is provided on said first surface of said base board, said second transmitting and receiving circuit is provided on said second surface of said base board, and said first and second transmitting and receiving circuits are both positioned on a same side of said patches, and a circuit for optionally selecting ones of said first and second patches for changing the directivities of said first and second antennas with respect to each other.

14. An antenna system as recited in claim 13 wherein said first and second transmitting and receiving circuits are capable of selecting any of said patches to or from which the electrical signals are to be fed or received and phases of the selected patches.

15. An antenna system as recited in claim 13 wherein said base board comprises an earth plate made of an electrically conductive material and a pair of dielectric substrates sandwiching said earth plate therebetween, said feeders, said earth plate and one of said dielectric substrates disposed between said feeders and said earth plate together constitute microstrips, said first patches, said earth plate and said one dielectric substrate disposed between said first patches and said earth plate together constitute patch antennas, and said second patches, said earth plate and another of said dielectric plates disposed between said second patches and said earth plate together constitute inductance-coupling patch antennas with a plurality of slots formed in said earth plate.

16. An antenna system as recited in claim 13 wherein said first patches and said second patches are arrayed alternately on said first surface of said base board.

17. An antenna system as recited in claim 13 which further comprises an additional dielectric substrate covering said second surface of said base board.

18. An antenna system as recited in claim 13 which further comprises an additional dielectric substrate that includes an additional earth plate covering said second surface of said base board.

* * * * *